US005397600A

United States Patent [19]

Shibata et al.

[11] Patent Number: 5,397,600

[45] Date of Patent: Mar. 14, 1995

[54] METHOD OF EXTRUSION COATING

[75] Inventors: Norio Shibata; Akihiro Suzuki; Shinsuke Takahashi; Mikio Tomaru, all of Kanagawa, Japan

[73] Assignee: Fuji Photo Film Co., Ltd., Kanagawa, Japan

[21] Appl. No.: 132,328

[22] Filed: Oct. 6, 1993

[30] Foreign Application Priority Data

Oct. 20, 1992 [JP] Japan ..... 4-306192

[51] Int. Cl.[6] ..... B05D 3/12

[52] U.S. Cl. ..... 427/358; 427/356; 427/128; 427/131; 118/410; 118/411

[58] Field of Search ..... 427/131, 356, 358, 128; 118/410, 411

[56] References Cited

U.S. PATENT DOCUMENTS

| | | | |
|---|---|---|---|
| 4,480,583 | 11/1984 | Tanaka et al. | 118/410 |
| 4,907,530 | 3/1990 | Shibata et al. | 118/410 |
| 4,968,528 | 11/1990 | Tanaka et al. | 427/131 |
| 5,083,524 | 1/1992 | Hiraki et al. | 427/131 |
| 5,250,320 | 10/1993 | Suzuki et al. | 427/128 |

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A coating method and coating apparatus with which a thin film having a uniform thickness free from stripe or step unevenness of a coating composition is formed at a high speed. An extrusion-type coating head is provided which has a front edge and at least one back edge, the front edge being disposed on the upstream side in the direction of movement of a support, the back edge being disposed on the downstream side in the direction of movement of the support, and the back edge having a top end which is set back stepwise from the front edge in the direction away from the support. Coating is performed under the conditions that the pressure $P_c$ of the coating composition at a point of application of the coating composition onto the support is in a range of $0 \leqq P_c \leqq 0.25$ kgw/cm$^2$, while liquid sealing is obtained with a composition mainly containing an organic solvent applied in advance to a coating surface of the support. The ratio of $t_1/t_0$ satisfies the relation $0.2 \leqq t_1/t_2 \leqq 20$, where $t_0$ represents the thickness of the coating composition before drying just after coating, and $t_1$ represents the length of a perpendicular line from the top end of the most downstream side back edge to a tangent drawn between the front edge and a conveyance roll on the downstream side of the coating head.

5 Claims, 4 Drawing Sheets

METHOD OF EXTRUSION COATING

BACKGROUND OF THE INVENTION

The present invention relates to a coating method and a coating apparatus, and particularly relates to a coating method and a coating apparatus using an extrusion-type coating head for coating the surface of a running support with a coating composition extruded toward the surface of the support continuously to thereby form a thin film coating on the support with a uniform thickness at a high speed.

Conventionally, various extrusion-type coating apparatuses for coating the surface of a running support with a coating composition extruded onto the surface of the support continuously to thereby form a thin film with a uniform thickness at a high speed have been known, for example, as disclosed in Japanese Patent Unexamined Publications Nos. Sho-57-84771, Sho-58-104666, Sho-59-238179, Sho-63-88080, Sho-63-164022, Hei-2-17971, etc. As a method of sealing an upstream-side edge of a coating head with a pre-coating layer to block off air accompanying a coating layer, there have been disclosed a method of performing pre-coating with a composition having the same components (see Japanese Patent Unexamined Publication No. Sho-58-205561), a method of coating a support with a solvent as a pre-coating (see Japanese Patent Unexamined Publication No. Sho-61-139929), etc. With such coating methods, it is possible to realize coating with a thin film at a high speed.

When any such coating method is applied to an extrusion-type coating apparatus, a pressed state is produced between a downstream-side edge and a support to thereby smooth a coating layer. As a result, if there is an unevenness in the widthwise direction of the support, the thickness of the coating film is also made uneven in the widthwise direction. Further, if foreign matter is present on the support or mixed in the pre-coating composition, coating layer or coating composition, the foreign matter is apt to be trapped on the downstream-side edge, so that stripes are produced.

For the coating composition, there are available, for example, a photographic photosensitive coating composition, a magnetic coating composition, a surface-protection/charge-prevention or smoothing coating composition, etc. As representative products produced thereby, there are various kinds of photographic film, printing papers, magnetic recording media, etc.

Commonly assigned Japanese Patent Unexamined Publication No. Sho-63-20069 describes a coating apparatus in which it is possible to prevent variations in thickness of a coating film caused by stripe faults or unevenness in support thickness, Young's modulus, etc., and it is further possible to reduce pressure losses when a coating composition passes through a slot.

Further, Japanese Patent Unexamined Publication No. Sho-63-20069 discloses a coating apparatus for forming a coating layer on a support 1 having a coating surface to be coated which is liquid-sealed with an organic solvent 6 applied thereon in advance, using an extrusion-type head having a front edge 2 disposed on the upstream side in the direction of movement of the support, and a back edge 3 disposed on the downstream side in the direction of movement of the support, the back edge 3 having a top end which recedes stepwise than the front edge in the direction away from the support and having an acute-angled top end portion, as shown in FIG. 5.

First, the coating surface of the support is coated with an organic solvent by a conventional coating apparatus such as a gravure coater, a roll coater, a blade coater, an extrusion coater, a rod coater, a wire bar coater, or the like, so that the thus-formed layer prevents air accompanying the front edge upstream side from intruding into the coating layer, thereby to make it possible to maintain a coating state with no faults and to improve high speed coating characteristics.

The front edge 2 is disposed on the upstream side of the support 1 from the exit of the slit 8, and is formed so that the whole area of the edge surface opposite the support 1 bulges toward the support 1. Although a curved surface having a certain curvature is generally used as the shape of the bulge toward the support, the shape is not limited to this, and any shape may be used so long as it can prevent accompanying air from being caught into.

The back edge 3 is disposed so that its top end portion is positioned so as to be away, in the direction opposite to the support, from a tangent drawn to the front edge 2 at the exit portion of the slit 8. Consequently, no pressure force from the support 1 acts against the back edge 3, so that the entrapment of foreign matter at this portion can be prevented. Accordingly, coating surface faults caused by the foreign matters can be reduced.

In an extrusion-type coating head as shown in FIG. 5, however, it has become understood that many stripes can be produced according to the conditions of the surface roughness of a front edge surface 5 and a back edge surface **3*b* of its top end portion, and the conditions of edge angled portions 9 and 11**.

This means that although the front edge surface 5 and the back edge surface **3*b* in the above-mentioned coating head are ground into required shapes with a high accuracy by using a grinding machine, undesirable conditions may occur in the surface roughness, the straightness of the edge angled portions 9 and 11, etc., in accordance with the conditions at this grinding process, such as the feeding speed, the cutting depth, the selection of grinding tool, or the like, or some material of the coating head top end portion makes conditions, such as the surface roughness, the straightness of the edge angled portions 9 and 11**, etc., so that there is a tendency for such undesirable conditions to be manifest on the casting surface directly.

That is, in a conventional coating head having a doctor edge, such as that disclosed in Japanese Patent Unexamined Publication No. Sho-60-238179, or the like, a coating composition is smoothed by the doctor edge (back edge) so that even if the front edge surface 5 and the back edge surface 6 mentioned above are somewhat poor in their surface roughness or have broken portions, the fluid function of the coating composition immediately after application is increased by an internal stress produced by the pressure applied to the coating composition as a result of the above smoothing function.

It could be considered that the finished states of surface roughness of the respective edge surfaces can be compensated by varying the liquid behavior of the coating composition ejected from a slit. However, one would not wish to apply high pressure to the coating composition at the time of coating as shown in FIG. 3, or otherwise coating stripes or unevenness of thickness would be apt to appear to cause deterioration in the quality of the coating surface.

As has been described above, if smoothing by a doctor edge desirably is performed, if rough surface conditions or broken portions exist in a slit inner surface and a front edge surface, not only are faults such as stripes are caused, but also, particularly, unevenness of thickness is produced according to the degree of the straightness of the respective surfaces. Accordingly, not only it is required that there be no surface roughness or broken portions in the slit inner surface and the front edge surface as well as in the back edge surface, but also it is particularly required that the straightness be good in the slit width direction.

It is, however, impossible to make the conditions of the ground or surface-finished state of the coating head high to an unlimited extent. Moreover, the finished state of the coating head has depended to a large extent on the operator's experience and skill.

SUMMARY OF THE INVENTION

It is therefore an object of the present invention to provide a coating method and a coating apparatus in which the foregoing problems of the conventional approaches are solved, and by which variations in thickness of a coating film in the widthwise direction caused by unevenness in the widthwise direction of a support in a non-pressure-type coating head are suppressed so that products coated with a thin film having uniform coating thickness and having no faults of unevenness, particularly magnetic recording media having superior electromagnetic conversion characteristics, can be manufactured stably at a high speed.

The foregoing and other objects of the present invention have been attained by a coating method for coating at least one coating composition by an extrusion-type coating head which has a front edge and at least one back edge, the front edge being disposed on the upstream side in the direction of movement of a support, the back edge being disposed on the downstream side in the direction of movement of the support, the back edge having a top end which recedes stepwise further than the front edge in the direction away from the support, characterized in that coating is performed under the conditions that the pressure $P_c$ of the coating composition at a point of application of the coating composition onto the support is in a range of $0 \leqq P_c \leqq 0.25$ kgw/cm$^2$ while a liquid seal is provided by a composition mainly containing an organic solvent applied in advance to a coating surface of the support, and the ratio of $t_1/t_0$ satisfies the relation $0.2 \leqq t_1/t_0 \leqq 20$ where $t_0$ represents the thickness of the coating composition prior to drying just after coating, and $t_1$ represents the length of a perpendicular line from the top end of the most downstream side back edge to a tangent drawn between the front edge and a conveyance roll on the downstream side of the coating head.

Further, the foregoing objects of the present invention are attained by the above-mentioned coating method in which, in the case of applying a plurality of coating compositions, the coating composition pressure $P_c$ at a point of application of the uppermost layer coating composition is used as a representative value for the whole of the coating compositions.

The above objects of the present invention are further attained by a coating apparatus for coating at least one coating composition with an extrusion-type coating head which has a front edge and at least one back edge, the front edge being disposed on the upstream side in the direction of movement of a support, the back edge being disposed on the downstream side in the direction of movement of the support, and the back edges having a top end which recedes stepwise than the front edge in the direction away from the support, characterized in that in a liquid sealing condition is provided by a composition mainly containing an organic solvent applied in advance to a coating surface of the support, the gap width accuracy in the direction of the width of the support at a slit for ejecting the coating composition is not larger than 5% of the average gap width, and the straightness of edge surfaces of the front edge and the back edge in the direction of width of the support is not larger than 30 μm.

DESCRIPTION OF THE PREFERRED EMBODIMENTS

Figure 1:
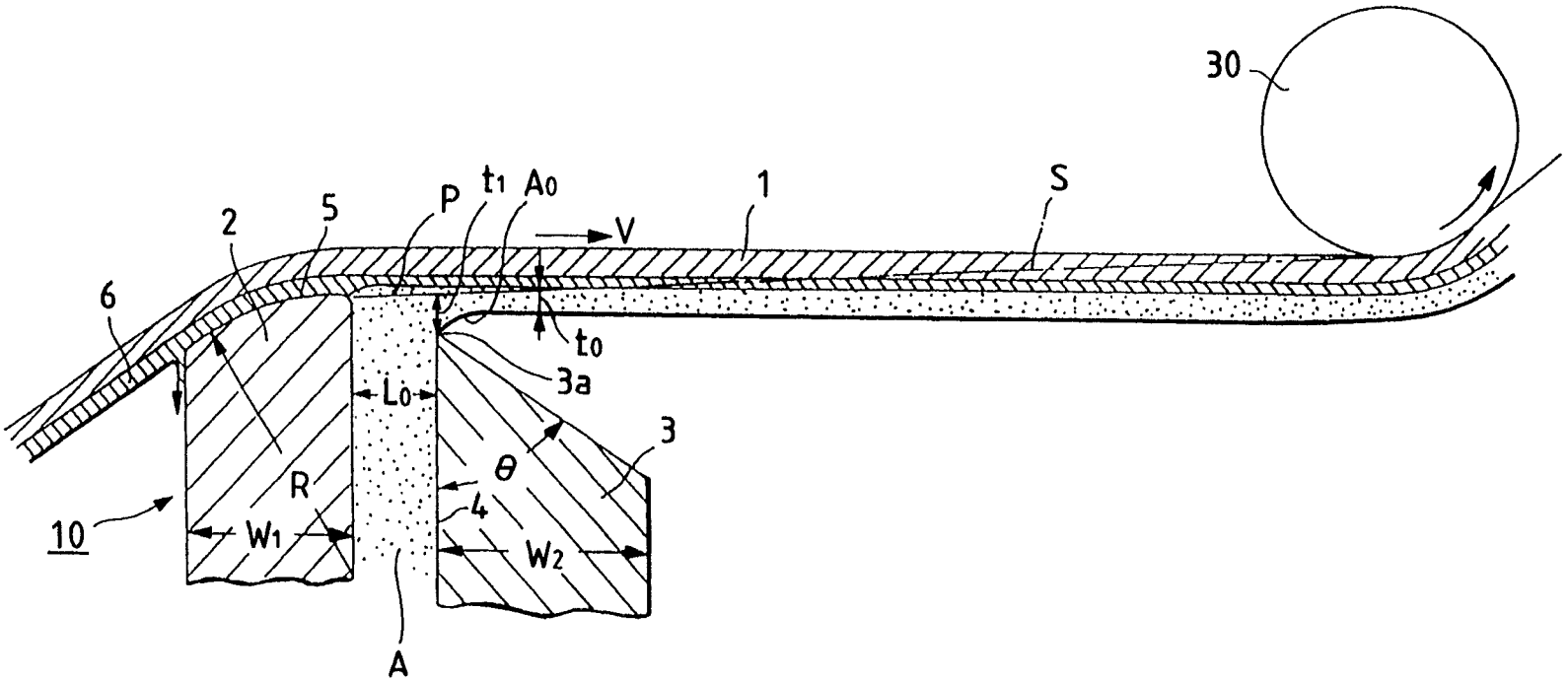
FIG. 1 is an enlarged sectional view of important parts of a coating head constructed according to the present invention and a schematic view of other important parts, showing a state of coating.
Figure 2:
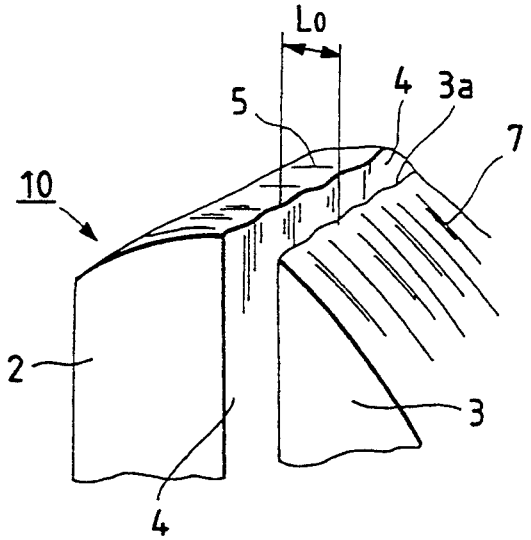
FIG. 2 is a perspective view of important parts of the coating head depicted in FIG. 1.

A preferred embodiment of the present invention will be described below with reference to FIGS. 1 and 2. FIG. 1 is a cross-sectional view of a coating head for applying a magnetic liquid to form a magnetic recording layer and a schematic view showing the state of application by the coating head. FIG. 2 is a perspective view of important parts of the coating head.

In the coating head 10 shown in FIGS. 1 and 2, a front edge 2 (an edge on the upstream side in the direction of running of a support 1) is formed so that its whole front edge surface 5 opposite to the support 1 extends toward the support. Although a curved surface having a curvature (R) is generally used, the shape is not limited to that shown, and any shape, such as a flat single or multi-surface shape, may be used so long as it can prevent air accompanying the support 1 from being entrapped. A top end of a back edge 3 is formed so as to be lower than a top portion of the front edge 2. That is, the top end of the back edge 3 is formed so that it is set back relative to the support 1 suitably with a difference in level relative to the front edge 2.

A slit portion 4 formed by the front edge 2 and the back edge 3 may have a portion tapering toward the point of coating to the support from a pocket portion 5 (see FIG. 3) or may have a parallel portion.

In this embodiment, the coating head is disposed between a pair of conveyance rolls 30 (for simplification, one roll on the downstream side in the direction of running of the support is shown in the drawing). Although the lap angle of the support 1 in the coating head 10 and the span in the conveyance rolls 30 to form this lap angle are generally set to about 2° to about 60° and 50 mm to 3000 mm, respectively, they are not limited to these particular ranges.

The coating surface of the support 1 is coated with a liquid 6, mainly containing an organic solvent, in advance by a separate coating device (not shown). Accordingly, when a magnetic coating composition A is to be applied, a liquid sealing state with respect to the liquid 6 is produced between the front edge surface 5 and the support 1. Strictly, the gap width $L_0$ in the direction of the width of the support in the slit portion 4 from which the magnetic coating composition A is ejected varies in the direction of the width of the support as shown in FIG. 2, because two opposite wall surfaces (front edge side and back edge side wall surfaces) in the slit portion 4 are not perfectly flat because of small undulations thereof or the like.

In this embodiment, therefore, the gap width accuracy is made not larger than 5% compared with the gap width average. The gap width $L_0$ may be measured or calculated, for example, by tracing the two wall surfaces of the slit in the direction of width of the support using a probe, or it may be measured suitably by another method. The front edge surface 5 and the back edge surface 7 are formed so that the straightness in the direction of the width of the support is not larger than 30 μm. With respect to the measurement of the straightness, there may be used, for example, a method in which a form to be measured is expressed by displacement measurements using deviations with respect to a line or plane used as a reference. Specifically, the straightness of the respective edge surfaces can be measured easily using a line or plane such as a straight edge, a test bar, a stretched steel wire, a light beam, a surface plate, an optical flat, or the like, as a reference.

When the gap width average and the straightness are set to be not larger than the above-mentioned respective values in the case where the magnetic coating composition A is not smoothed by the edge surfaces as shown in this embodiment, not only can variations in thickness of the coating layer be well suppressed but also occurrence of stripe faults on the coating surface can be prevented.

For example, the gap width $L_0$ of the slit portion 4 can be set to be in a range of from about 0.05 mm to about 1.5 mm.

A known technique can be used for a liquid feeding system in accordance with the quality of the coating composition. Particularly in the case of a magnetic coating composition, it is preferable to apply a shear force which does not cause condensation because the magnetic coating composition generally has a coagulation characteristic. For example, preferably the diameter of the pipe arrangement between a liquid-feeding pump and the coating head is not larger than 50 mm$^{\Phi}$, the pocket diameter of the coating head is generally 2 to 20 mm$^{\Phi}$, and the slit length is 5 to 150 mm, but these parameters are not always limited to these ranges.

Examples of the material for the coating head 10 in this embodiment include stainless steel, high-speed steel, etc. In the case where highly accurate finishing is required, hard metals or ceramics are preferably used as the material.

When a coating process is to be carried out by using the coating head 10 configured as described above, coating is performed while the coating composition pressure $P_c$ at the point P of application of the magnetic coating composition A onto the support is kept in a range of $0 \leqq P_c \leqq 0.25$ kgw/cm$^2$ under the condition that the coating surface of the support 1 is coated with the liquid 6 mainly containing an organic solvent in advance and is sealed with the liquid 6. At the same time, coating is performed so that the value of the ratio $t_1/t_0$ of the thickness to the length satisfies $0.2 \leqq t_1/t_0 20$, where $t_0$ represents the thickness of the magnetic coating composition A prior to drying and just after coating, and $t_1$ represents the length of a perpendicular line from the top end 3*a* of the back edge to a tangent S drawn from the front edge 2 to the conveyance roll 30 on the downstream side of the coating head 10.

The coating composition pressure $P_c$ at the point of application can be measured or calculated by the following method.

The liquid pressure is measured at an arbitrary point of the piping for feeding liquid to the coating head 10, during application of the magnetic coating composition A of the running support 1. A value obtained by subtracting from this measured value a value of pressure measured at the same point in the case where the same quantity (liquid-feeding quantity per unit time) of the coating composition as in this coating state is discharged directly to the air is made equal to the value of the coating composition pressure $P_c$. Accordingly, the coating composition pressure $P_c$ can be considered as the pressure in the vicinity of the exit of the slit in the coating state.

The coating composition pressure $P_c$ in a support-pressure type coating head has been disclosed, for example, in Japanese Patent Unexamined Publication No. Sho-62-11766. In the support-pressure type coating head, it is impossible to set the coating composition pressure $P_c$ to be not larger than a critical value (value of pressure required for removing air) in order to remove air accompanying the support. Accordingly, in the support-pressure type coating head, the elastic force of the support has a large influence on the coating state, so that the gap between the support surface and the doctor edge surface is apt to vary, for example, in accordance with variations in thickness of the support. Consequently, the thickness of the coating film is apt to vary. In this embodiment in which the coating composition pressure $P_c$ can be set to be a very small value as described above, variations in thickness of the coating film can be avoided easily compared with the pressure type. Particularly in the case where the coating composition pressure $P_c$ is set to be not larger than the above-mentioned predetermined value, variations in thickness of coating film can be avoided very easily. Further, the entrapment of foreign matter in the edge portions and the occurrence of stripe faults on the coating surface can be prevented.

The value of the perpendicular length $t_1$ is substantially equal to the value of the gap between the top end portion 3*a* of the back edge 3 and the surface of the support 1 coated with the liquid 6. It has been found that many stripe faults occur on the coating surface when the value of the ratio $t_1/t_0$ is larger than about 20 as a boundary value. It has further been found that stripe faults also occur on the coating surface when the value of the ratio $t_1/t_0$ is smaller than about 0.2 as a boundary value.

In the case where the value of the ratio $t_1/t_0$ is larger than about 20, the stripe faults are considered to result from the fact that the behavior of the free surface $A_0$ at the time of application of the magnetic coating composition A is unstable because the perpendicular length $t_1$ is sufficiently larger than the coating thickness $t_0$. To the contrary, in the case where the value of the ratio $t_1/t_0$ is smaller than about 0.2, it is estimated that the function of rubbing the magnetic coating composition A against the support side acts on the top end portion 3a of the back edge 3 so that stripes are caused by the entrapment of foreign matter at the top end portion 3a or the scraping of the support and by turbulence in the magnetic coating composition A caused by pressure at the sharp top end portion 3a.

Although components which will be described below by way of example can be used for the magnetic coating composition A, the components of the composition A used in the present invention are not limited thereto. Particularly in the case of a magnetic recording medium, the medium may have a single magnetic layer or a multilayer structure having a plurality of magnetic layers, or a magnetic layer-nonmagnetic layer combination structure containing at least one magnetic layer.

Figure 3:
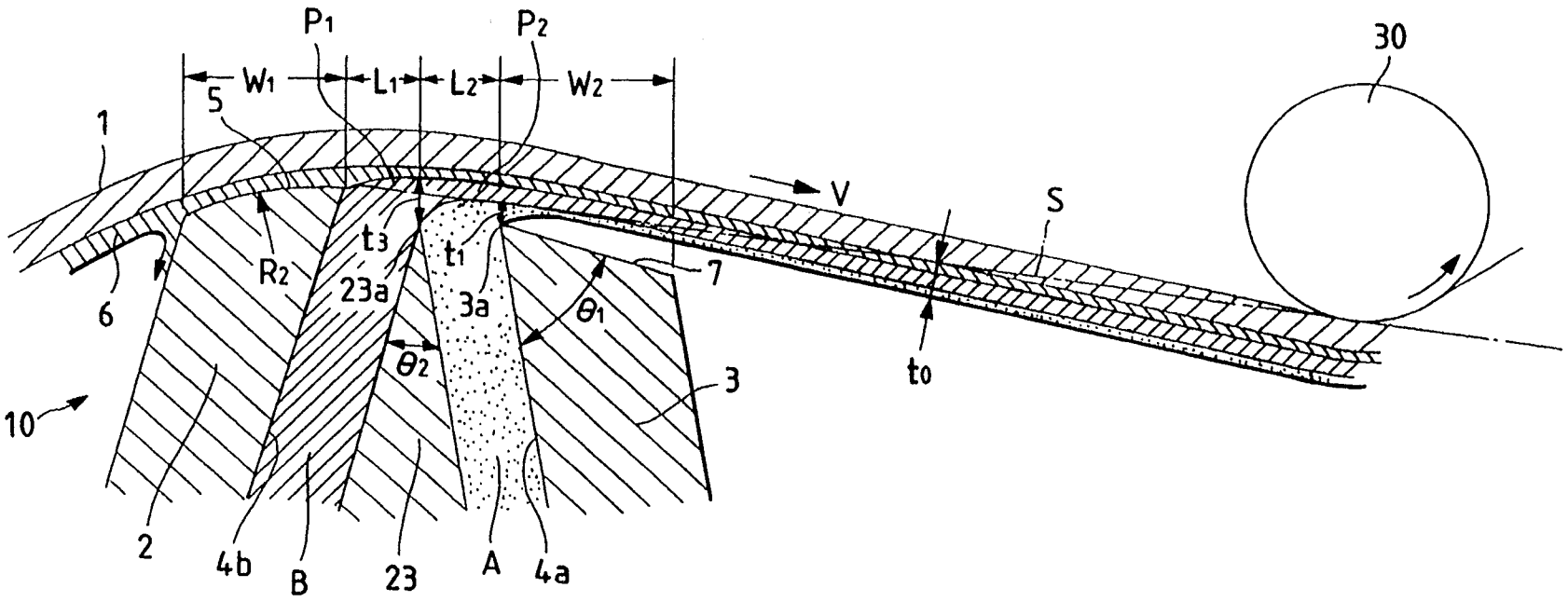
FIG. 3 is an enlarged sectional view of important parts of another coating head according to the present invention and a schematic view of other important parts, showing the state of coating.
Figure 5:
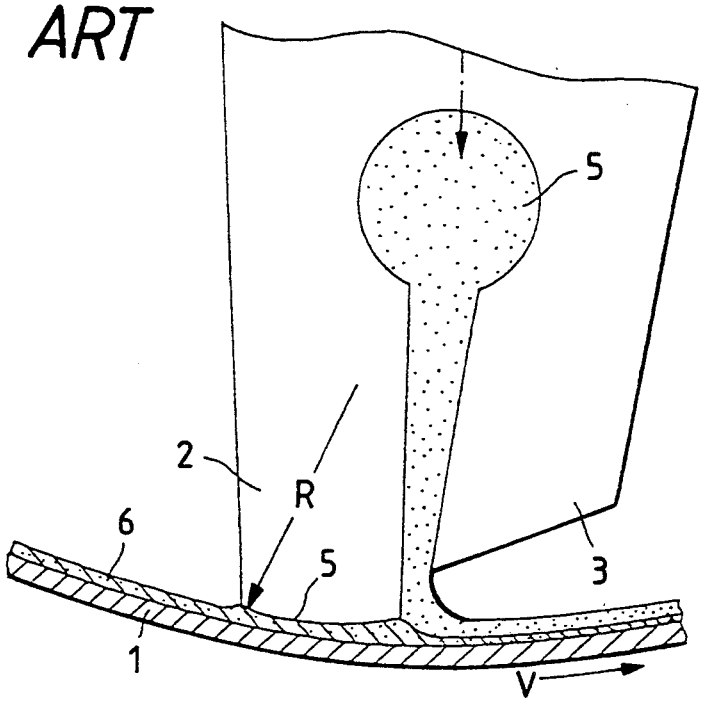
FIG. 5 PRIOR ART
FIG. 5 is a schematic view of a conventional coating head.

In the case of forming a multilayer, a multilayer-coating head 20 as shown in FIG. 3 can be used. Also in this case, the basic structure of the coating head 20 is substantially the same as the basic structure of the coating head 10 shown in FIG. 1, except that two slit portions 4a and 4b are formed by an intermediate block 23 in this case. In this configuration, for example, two kinds of magnetic coating compositions B and A, or a magnetic coating composition A and a nonmagnetic coating composition B can be applied simultaneously. In this case, two points $P_1$ and $P_2$ of application of coating compositions are employed, but the same theory as in the case of a single point P of application is applicable. That is, considering the coating composition pressure $P_c$ at the point $P_1$ of application and the coating composition pressure $P_c$ at the point $P_2$ of application separately in accordance with the coating composition, coating is performed so that the pressures at the two points satisfy the above-mentioned values.

Although the points of application of the respective coating compositions are a point $P_1$ of application for a lower layer and a point $P_2$ of application for an upper layer as shown in FIG. 3, it is necessary to prevent the occurrence of turbulence in the interface between the two coating compositions in the case of multilayer coating for reasons which will be described below. Because the liquid pressure of the lower layer liquid in the exit portion of the upper layer slit is substantially zero when $t_3$ is not smaller than a certain value, the coating composition pressure at the point ($P_2$) of application can be used as a representative value $P_c$. Accordingly, the coating composition pressures $P_c$ at the points $P_1$ and $P_2$ of application can be dealt with in the same manner, so that the pressure at the upper layer side point $P_2$ of application can be used as a representative value.

The perpendicular length $t_1$ can be considered in the same manner as in the case shown in FIG. 1, upon the assumption that the top end portion 23a of the intermediate block 3 is formed so that its height is substantially equal to that of the top end portion 3a of the back edge 3 (with a difference $t_3$ in level relative to the front edge 2). Further, in the case of a coating head in which the difference $t_3$ in level is larger than the perpendicular length $t_1$, the meeting point of the liquids is inside the slits, and analysis can be carried out in the same manner as in the case of a single layer shown in FIG. 1.

As the difference $t_3$ in level is reduced to a smaller value than the perpendicular length $t_1$, the liquid pressure of the lower layer-side coating composition increases to a larger value than the liquid pressure of the upper layer-side coating composition. As a result, liquid pressure balance between the two layers is maintained in a desirable state. In the case where the top end portion 23a comes close to the support 1, the same analysis as in the case illustrated in FIG. 1 can be applied to the entrapment of foreign matter, the scraping of the support, or the like.

To the contrary, in the case where the top end portion 23a is relatively far away the support 1 so that the ratio $t_3/t_0$ of the level difference $t_3$ to the perpendicular length $t_1$ exceeds 20, the same analysis of turbulence of the free surface cannot be applied to the lower layer side-coating composition B because there is no free surface for the lower layer side-coating composition B. In the case where the ratio $t_3/t_0$ exceeds 20, however, the two coating compositions A and B meet each other in the considerable front of the position of application thereof. Accordingly, the greater length of the meeting area is considered to be equivalent to turbulence at a free surface, so that the ratio $t_3/t_0$ substantially numerically coincides with the ratio $t_1/t_0$ in the above-mentioned specific range. Further, the case where such turbulence does not occur in the interface between the two coating compositions A and B can be considered to be substantially equivalent to the case of single layer coating.

The liquid mainly containing an organic solvent in the present invention may be contain singly an organic solvent such as toluene, methyl ethyl ketone, butyl acetate, cyclohexanone, etc., or a combination thereof. Further, the liquid may contain a small amount of solute (such as resin for an undercoating layer) as well as the organic solvent, but the liquid should be a low-viscosity liquid whose viscosity is not larger than 20 cp, preferably not larger than 5 cp.

In the present invention, ferromagnetic fine powder is used in the magnetic coating composition A or B to form a magnetic layer of a magnetic recording medium.

As the ferromagnetic fine powder, a known ferromagnetic fine powder such as $\gamma$-$Fe_2O_3$, Co-containing $\gamma$-$Fe_2O_3$, $Fe_3O_4$, Co-containing $Fe_3O_4$, $\gamma$-$FeO_x$ ($x=0.33$ to 1.50), $CrO_2$, a Co—Ni—P alloy, a Co—Ni—Fe—B alloy, an Fe—Ni—Zn alloy, an Ni—Co alloy, a Co—Ni—Fe alloy, etc., may be used. As the grain size of such ferromagnetic fine powder, the length is about 0.005 to 1 micron, and the ratio of axis-length/axis-width is about 1/1 to 50/1. The specific surface area of such ferromagnetic fine powder is about 1 to 70 $m^2/g$.

Pate hexagonal barium ferrite may be used as the ferromagnetic fine powder. As the grain size of barium ferrite, the diameter is about 0.001 to 1 micron, and the thickness is ½ to 1/20 of the diameter. The specific gravity of barium ferrite is 4 to 6 g/cc, and the specific surface area is 1 to 70 $m^2/g$.

In the present invention, a binder is used in the ferromagnetic coating composition to form a magnetic layer together with ferromagnetic fine powder. As the binder to be used, conventionally known thermoplastic resin, thermosetting resin, reaction resin, and a mixture thereof can be employed.

As for the thermoplastic resin, one may be used having a softening temperature not higher than 150° C., an average molecular weight in a range of from 10,000 to 300,000, and a degree of polymerization in a range of from about 50 to 2,000. Specifically, the thermoplastic resin may be selected from a copolymer of vinyl chloride and vinyl acetate, a copolymer of vinyl chloride and vinylidene chloride, a copolymer of vinyl chloride and acrylonitrile, a copolymer of acrylic ester and acrylonitrile, a copolymer of acrylic ester and vinylidene chloride, a copolymer of acrylic ester and styrene, a copolymer of methacrylic ester and acrylonitrile, a copolymer of methacrylic ester and vinylidene chloride, a copolymer of methacrylic ester and styrene, urethane elastomer, Nylon-silicon system resin, nitrocellulose-polyamide resin, polyvinyl fluoride, a copolymer of vinylidene chloride and acrylonitrile, a copolymer of butadiene and acrylonitrile, polyamide resin, polyvinylbutyral, cellulose derivatives (cellulose acetate butyrate, cellulose diacetate, cellulose triacetate, cellulose propionate, nitro cellulose, etc.), a copolymer of styrene and butadiene, polyester resin, a copolymer of chlorovinyl ether and acrylic ester, amino resin, thermoplastic resin of various synthetic rubber mixtures thereof, etc.

As for the thermosetting or reaction resin, one may be used having a molecular weight not larger than 200,000. If a composite to form a magnetic layer is applied, dried, and thereafter heated, however, such resin takes part in reactions such as condensation, addition, etc., to thereby cause the resin to have an unlimited molecular weight. Of such resins, a preferable one is not softened or dissolved before the resin is decomposed thermally. Specifically, examples of such resin include phenol resin, epoxy resin, setting polyurethane resin, urea resin, melamine resin, alkyd resin, silicon resin, reaction acrylic system resin, epoxy polyamide resin, nitrocellulose melamine resin, a mixture of high molecular weight polyester resin and an isocyanate prepolymer, a mixture of a methacrylate copolymer and a diisocyanate prepolymer, a mixture of polyester polyol and polyisocyanate, urea formaldehyde resin, a mixture of low molecular weight glycol, high molecular weight diol and triphenyl methane triisocyanate, polyamide resin, mixtures thereof, etc.

Similarly, as in the convention case, there may be used a ferromagnetic fine powder dispersed in a binder; a solvent; additives such as a dispersing agent, a lubricating agent, an abrasive agent, an antistatic agent; a non-magnetic support; etc.

Examples of the dispersing agent include a fatty acid of carbon number 12 to 18 ($R_1COOH$, $R_1$ representing alkyl or alkenyl group of carbon number 11 to 17), such as a caprylic acid, a capric acid, a lauric acid, a myristic acid, a palmitic acid, a stearic acid, an oleic acid, an elaidic acid, a linoleic acid, a linolenic acid, a stearolic acid; a metal soap consisting of alkali metal (Li, Na, K, etc.) or alkaline-earth metal (Mg, Ca, Ba) of the above-mentioned fatty acid; a compound including fluorine of the above-mentioned fatty acid ester; an amide of the above-mentioned fatty acid; polyalkylene oxide alkyl phosphate; lecithin; trialkyl polyolefin oxy quaternary ammonium salt (carbon number of alkyl is 1 to 5, olefin is ethylene, propylene, etc.); etc. Other than those mentioned above, higher alcohol of carbon number not less than 12, sulfuric ester, etc., may be used.

As for the lubricating agent, while the above-mentioned dispersing agents provide a lubricating effect, examples of a suitable lubricating agent include: conductive fine powder of silicon oil such as dialkyl polysiloxane (carbon number of alkyl is 1 to 5), dialkoxy polysiloxane (carbon number of alkoxy is 1 to 4), monoalkyl monoalkoxy polysiloxane (carbon number of alkyl is 1 to 5, and carbon number of alkoxy is 1 to 4), phenyl polysiloxane, phloroalkyl polysiloxane (carbon number of alkyl is 1 to 5), etc., conductive fine powder of graphite, etc.; inorganic fine powder such as molybdenum disulfide, tungsten dioxide, etc.; plastic powder such as polyethylene, polypropylene, polyethylene-vinyl chloride copolymer, polytetrafluoro-ethylene, etc.; an $\alpha$-olefin copolymer; unsaturated aliphatic hydrocarbons of liquid state at ordinary temperature ($\alpha$-olefin containing terminal carbon having a double bond, and a carbon number of about 20); fatty acid esters consisting of a mono-basic fatty acid of carbon number 12 to 20 and monohydric alcohol of carbon number 3 to 12, fluorocarbons, etc.

Examples of the abrasive agent include fused alumina, silicon carbide, chromium oxide ($Cr_2O_3$), corundum, artificial corundum, diamond, artificial diamond, garnet, emery (main components: corundum and magnetite), etc.

Examples of the antistatic agent include: conductive fine powder such as carbon black, carbon black graft polymer, etc.; natural surface active agent such as saponin; a nonionic surface active agents such as alkylene oxide surface active agents, glycerin surface active agents, glycidol surface active agents, etc.; cationic surface active agents such as higher alkyl amines, quaternary ammonium salts, pyridine and other heterocyclic compounds, phosphonium compounds and sulfonium compounds; anionic surface active agents having acidic groups such as carboxylic group, sulfonic group, phosphoric group, sulfuric ester group, phosphoric ester group, etc.; amphoteric surface active agents such as amino acids, amino-sulfonic acids, sulfuric or phosphoric esters of amino alcohol, etc.

Examples of the organic solvent to be used as a coating solvent include: ketones such as acetone, methyl ethyl ketone, methyl isobutyl ketone, cyclohexanone, etc.; esters such as methyl acetate, ethyl acetate, butyl acetate, ethyl lactate, glycol acetate monoethyl ether, etc.; tar products (aromatic hydrocarbons) such as benzene, toluene, xylene, etc.; chlorinated hydrocarbons such as methylene chloride, ethylene chloride, carbon tetrachloride, chloroform, ethylene chlorhydrin, dichlorbenzene; etc.

The quantity of the solvent is from two times to three times as much as that of the magnetic fine powder. Per 100 parts by weight of binder, the dispersing agent is 0.5 to 20 parts by weight, the lubricating agent is 0.2 to 20 parts by weight, the abrasive agent is 0.5 to 20 parts by weight, the conductive fine powder to be used as an antistatic agent is 0.2 to 20 parts by weight, and the surface active agent to be used also as an antistatic agent is 0.1 to 10 parts by weight.

The magnetic powder, the binder, the dispersing agent, the lubricating agent, the abrasive agent, the antistatic agent, the solvent, etc., are kneaded to form the magnetic coating composition.

Examples of the material for the support to be coated with the magnetic layer include: plastic film of polyesters such as polyethylene terephthalate, polyethylene naphthalate, etc.; polyolefins such as polypropylene, etc., cellulose derivatives such as cellulose triacetate, cellulose diacetate, etc., vinyl resins such as polyvinyl chloride, etc., polycarbonates, polyamide resin, polysulfone; metal materials such as aluminum, copper, etc.; ceramics such as glass, etc. These supports may be subjected to pre-treatment in advance, such as corona discharge treatment, plasma treatment, undercoating treatment, heat treatment, metal deposition treatment, alkali treatment, etc. The supports may have various shapes desirably.

As has been described above, in the coating method according to the present invention, the coating composition pressure $P_c$ at the point of application of the coating composition onto the support is maintained in a range of $0 \leqq P_c \leqq 0.25$ kgw/cm$^2$ in the condition in which the coating surface of the support is coated with a liquid mainly containing an organic solvent in advance and is sealed with the liquid. By setting the coating composition pressure $P_c$ to such a very small value, not only can variations in thickness of coating be avoided effectively compared with the pressure type, but also good coating can be performed so as to be free from the entrapment of foreign matter in the edge portions and free from stripe faults on the coating surface.

Further, coating is performed so that $0.2 \leqq t_1/t_0 \leqq 20$ is satisfied, where $t_0$ represents the thickness of the coating composition before being dried just after coating, and $t_1$ represents the length of a perpendicular line to the top end of the back edge from a tangent drawn between the front edge of the coating head and the conveyance roll on the downstream side of the coating head. Accordingly, by making the ratio $t_1/t_0$ larger, not only can turbulence in the behavior of the free surface at the time of application of the coating composition be avoided, but also problems caused by the entrapment of foreign matter at the top end portion of the back edge, the scraping of the support, and the like can be avoided. Consequently, a thin film having a uniform thickness can be formed so as to be free from stripe faults or step unevenness on the coating surface.

Further, for carrying out the above-mentioned method, the coating apparatus according to the present invention is constructed so that the straightness of edge surfaces of the front edge and the back edge in the direction of width of the support is made not larger than 30 μm, while the gap width accuracy, in the direction of the width of support, in a slit for ejecting the coating composition is not larger than 5% compared with the gap width average. Accordingly, in the case where the coating composition rubs against the support as in the coating apparatus according to the present invention, not only are stripe faults or unevenness of thickness hardly produced on the coating surface but also a thin film having a stable behavior can be ejected from the slit. Consequently, a good thin film can be formed at a high speed.

EXAMPLES

The effects of the present invention will be clarified by way of examples.

Example 1

After the components of each of the coating compositions shown in Tables 1 and 2 were put into a ball mill, mixed and sufficiently dispersed, epoxy resin (epoxy equivalent 500) was added thereto in an amount of 30 parts by weight, mixed and dispersed uniformly to thereby prepare two kinds of magnetic coating compositions A and B (different in ferromagnetic fine powder).

Figure 4:
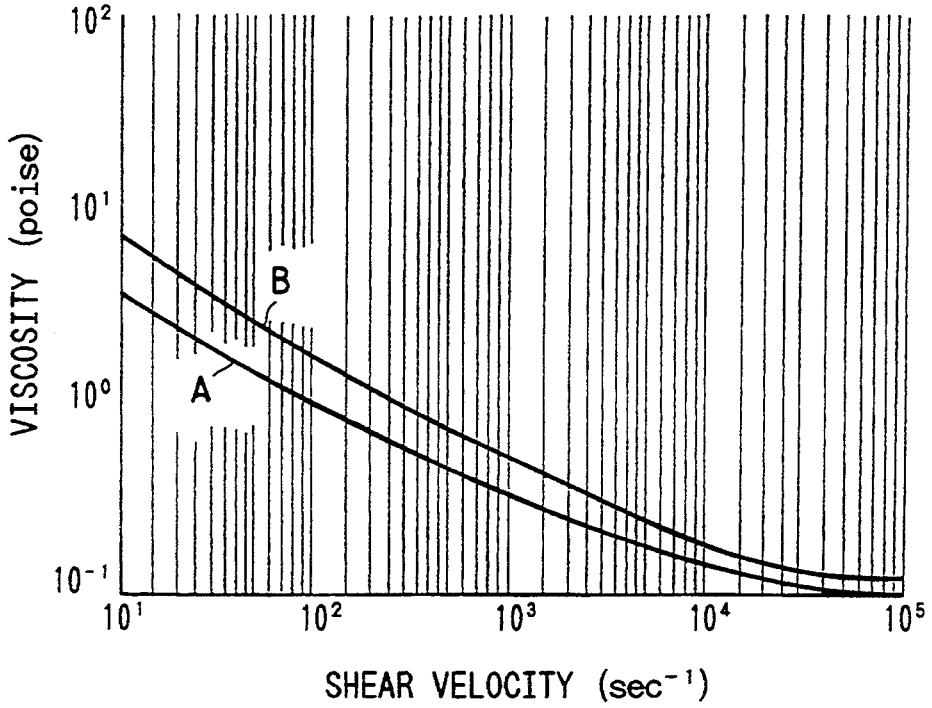
FIG. 4 is a graph showing viscosity curves of magnetic coating compositions used in a coating method according to the present invention.

When the respective viscosities of the thus-prepared magnetic coating compositions were measured by a roto-viscometer, thixotropic viscosities were exhibited as shown in FIG. 4.

TABLE 1

| Magnetic Coating Composition A | |
|---|---|
| $\gamma$-$Fe_2O_3$ powder (needle-like particles of average grain size in the direction of length: 0.5 μm, coercive force: 320 oersted) | 300 parts by weight |
| vinyl chloride-vinyl acetate copolymer (copolymerization ratio: 87:13, copolymerization degree: 400) | 30 parts by weight |
| conductive carbon | 20 parts by weight |
| polyamide resin (amin-valent: 300) | 15 parts by weight |
| lecithin | 6 parts by weight |
| silicon oil (dimethyl polysiloxane) | 3 parts by weight |
| xylene | 300 parts by weight |
| methyl isobutyl ketone | 300 parts by weight |
| n-butanol | 100 parts by weight |

TABLE 2

| Magnetic Coating Composition B | |
|---|---|
| Co-$\gamma$-$Fe_2O_3$ powder (needle-like particles of average grain size in the direction of length: 0.3 μm, coercive force: 670 oersted) | 300 parts by weight |
| vinyl chloride-vinyl acetate copolymer (copolymerization ratio: 87:13, copolymerization degree: 400) | 30 parts by weight |
| conductive carbon | 20 parts by weight |
| polyamide resin (amin-valent: 300) | 15 parts by weight |
| lecithin | 6 parts by weight |
| silicon oil (dimethyl polysiloxane) | 3 parts by weight |
| xylene | 300 parts by weight |
| methyl isobutyl ketone | 300 parts by weight |
| n-butanol | 100 parts by weight |

Further, methyl isobutyl ketone was used as the liquid 6 serving as a pre-coating composition, and applied to a thickness of 2.0 μm (wet state) using a bar coating system.

Coating heads shown in FIGS. 1 and 3 were used as a coating head.

In the coating head shown in FIG. 1, the width $W_1$ of th e front edge 2 was 1.0 mm; the width $W_2$ of the back edge 3 was 1.0 mm; the width $L_0$ of the slit portion 4 was 0.4 mm; and the angle $\theta$ of the back edge top portion was be 55°.

In the coating head shown in FIG. 3, the width $W_1$ (horizontal width) of the front edge 2 was 1.0 mm; the width $W_2$ (horizontal width) of the back edge 3 was 1.0 mm; the widths $L_1$ and $L_2$ (horizontal widths) of the slit portions 4a and 4b were both 0.4 mm; the angle $\theta_1$ of the back edge top portion was 55°; and the angle $\theta_2$ of the intermediate block top portion was be 20°.

A polyethylene terephthalate film having a thickness of 15 μm and a width of 500 mm was used as the support 1. The support was made to run under conditions of a tension of 10 kg/whole width and a coating speed of 400 m/min. The same conditions as to the support and the tension thereof were applied to comparative examples.

The relation between the coating composition pressure $P_c$ and the variations of coating film thickness was measured using the coating head 10 shown in FIG. 1 while changing the quantity of the coating composition A to be applied. The value of coating composition pressure $P_c$ was adjusted by changing the difference in level between the front edge top portion and the back edge top portion, that is, by moving the back edge.

Next, the coating compositions A and B were applied simultaneously using the coating head 20 shown in FIG. 3 so that the coating compositions A and B were used to form lower and upper layers, respectively, reversely to that shown. Further, the relation between the coating composition pressure $P_c$ and the fluctuation of coating film thickness at a point ($P_2$) of application of the upper layer coating composition was measured while changing the quantities of the coating compositions A and B to be applied. Points of application of the coating compositions A and B are a point $P_1$ of application of the lower layer and a point $P_2$ of application of the upper layer respectively as shown in FIG. 3. As described above, in multilayer coating, it is of course necessary to prevent turbulence or the like in the interface between the two coating compositions. Accordingly, the values of the coating composition pressure $P_c$ at the two application points ($P_1$) and ($P_2$) can be equal to each other. That is, in the case where $t_3$ is not smaller than a certain value, the liquid pressure of the lower layer liquid at the upper layer slit exit portion is substantially zero, so that the coating composition pressure at the application point ($P_2$) can be used as a representative value $P_c$.

The top portion 23*a* of the intermediate block 23 and the top portion 3*a* of the back edge 3 are formed so that their heights are provided with a substantially equal difference in level relative to a tangent line S drawn from the edge surface of the front edge 2 to the conveyance roll 30. In this example, the value of the coating composition pressure $P_c$ was adjusted by slightly moving up and down the top portion 3*a* of the back edge 3 to adjust the value of the upper layer coating composition pressure $P_c$ while fixing the level difference $t_3$ of the top portion 23*a* to 50 μm.

The amount of variation of the coating film thickness was calculated as follows.

(maximum variation of thickness in the direction of width of the support/average thickness)×100(%)

The case where the value was not larger than 8%, the case where the value was in a range of 8% to 12%, and the case where the value was not smaller than 12% were indicated as , Δ and X respectively. Results in the case of use of the coating head 10 were shown in Table 3. Results as to the relation between coating composition pressure $P_c$ at the upper layer liquid application point $P_2$ and the variation of thickness in the case of use of the coating head 20 were shown in Table 4.

TABLE 3

| $P_c$ (kgw/cm²) | Relation Between $P_c$ and Variation of Thickness: Quantity of Coating (cc/mm²) 5 | 10 | 15 | 20 | 25 |
|---|---|---|---|---|---|
| 0.00 | ○ | ○ | ○ | ○ | ○ |
| 0.05 | ○ | ○ | ○ | ○ | ○ |
| 0.10 | ○ | ○ | ○ | ○ | ○ |
| 0.15 | ○ | ○ | ○ | ○ | ○ |
| 0.20 | ○ | ○ | ○ | ○ | ○ |
| 0.25 | ○ | ○ | ○ | ○ | ○ |
| 0.30 | Δ | Δ | Δ | Δ | x |
| 0.35 | x | x | x | x | x |

TABLE 4

Relation Between Coating Composition Pressure $P_c$ and Variation of Thickness at Point of Application ($P_2$) of Upper Layer Liquid for Simultaneous Two-Layer Coating

| $P_c$ (kgw/cm²) | Upper Layer Coating Quantity (cc/mm²)/ Lower Layer Coating Quantity (cc/mm²): 3/12 | 6/12 | 12/12 | 3/6 | 3/18 |
|---|---|---|---|---|---|
| 0.00 | ○ | ○ | ○ | ○ | ○ |
| 0.05 | ○ | ○ | ○ | ○ | ○ |

TABLE 4-continued

Relation Between Coating Composition Pressure $P_c$ and Variation of Thickness at Point of Application ($P_2$) of Upper Layer Liquid for Simultaneous Two-Layer Coating

| $P_c$ (kgw/cm²) | Upper Layer Coating Quantity (cc/mm²)/ Lower Layer Coating Quantity (cc/mm²): 3/12 | 6/12 | 12/12 | 3/6 | 3/18 |
|---|---|---|---|---|---|
| 0.10 | ○ | ○ | ○ | ○ | ○ |
| 0.15 | ○ | ○ | ○ | ○ | ○ |
| 0.20 | ○ | ○ | ○ | ○ | ○ |
| 0.25 | ○ | ○ | ○ | ○ | ○ |
| 0.30 | Δ | x | x | Δ | x |
| 0.35 | x | x | x | x | x |

Example 2

Coating was performed by using two different types of coating heads, each substantially having the structure shown in FIG. 1.

The coating composition A shown in Table 1 was applied by the coating head 10 shown in FIG. 1. The case where the width $W_1$ of the front edge 2, the width $W_2$ of the back edge 3, the width $L_0$ of the slit portion 4 and the angle θ of the back edge top portion were 1.0 mm, 1.0 mm, 0.3 mm and 55°, respectively, was made sample M. The production of stripes on the coating surface was visually evaluated while changing the coating speed, perpendicular length $t_1$ and coating thickness $t_0$. Results of the measurement were shown in Tables 6, 7 and 8.

On the other hand, the coating composition A shown in Table 1 was applied by the coating head 10 shown in FIG. 1 in the same manner as described above. The case where the width $W_1$ of the front edge 2, the width $W_2$ of the back edge 3, the width $L_0$ of the slit portion 4 and the angle θ of the back edge top portion were set to be 1.5 mm, 1.0 mm, 0.4 mm and 55° respectively was made sample N. The production of stripes on the coating surface was evaluated visually while changing the coating speed, perpendicular length $t_1$ and coating thickness $t_0$. Results of the measurement are shown in Tables 9, 10 and 11.

The situation of production of stripes on the coating surface was evaluated visually while changing the coating speed, the perpendicular length $t_1$ and the coating thickness $t_0$. As for the perpendicular length $t_1$, the ratio $t_1/t_0$ of the perpendicular length to the coating thickness was adjusted/changed by changing the difference in level between the downstream end portion of the front edge and the top portion of the back edge and moving up and down the position of the conveyance roll 30. At that time, the coating composition pressure $P_c$ was not larger than 0.20 kgw/cm². In the evaluation in the respective Tables, represents superior surface characteristics of the coating film, Δ represents slightly inferior surface characteristics of the coating film, and X represents the existence of problems in the form of stripes and unevenness of thickness which occur frequently.

The same conditions as in Example 1 were used as the condition for the support and the tension thereof.

TABLE 5

Production of Stripes in Sample M

| $t_1$ (mm) | $t_0$ (mm) | $t_1/t_0$ | Coating Speed (m/min) 100 | 200 | 300 | 400 | 500 |
|---|---|---|---|---|---|---|---|
| 0.000 | 0.020 | 0.0 | x | x | x | x | x |
| 0.002 | 0.020 | 0.1 | x | x | x | Δ | Δ |

TABLE 5-continued

| Production of Stripes in Sample M | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.004 | 0.020 | 0.2 | ○ | ○ | ○ | ○ | ○ |
| 0.010 | 0.020 | 0.5 | ○ | ○ | ○ | ○ | ○ |
| 0.020 | 0.020 | 1.0 | ○ | ○ | ○ | ○ | ○ |
| 0.100 | 0.020 | 5.0 | ○ | ○ | ○ | ○ | ○ |
| 0.200 | 0.020 | 10.0 | ○ | ○ | ○ | ○ | ○ |
| 0.300 | 0.020 | 15.0 | ○ | ○ | ○ | ○ | ○ |
| 0.400 | 0.020 | 20.0 | ○ | ○ | ○ | ○ | ○ |
| 0.450 | 0.020 | 22.5 | Δ | Δ | Δ | x | x |
| 0.500 | 0.020 | 25.0 | x | x | x | x | x |

TABLE 6

| Production of Stripes in Sample M | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.00 | 0.010 | 0.0 | x | x | x | x | x |
| 0.001 | 0.010 | 0.1 | x | x | x | x | Δ |
| 0.002 | 0.010 | 0.2 | ○ | ○ | ○ | ○ | ○ |
| 0.005 | 0.010 | 0.5 | ○ | ○ | ○ | ○ | ○ |
| 0.010 | 0.010 | 1.0 | ○ | ○ | ○ | ○ | ○ |
| 0.050 | 0.010 | 5.0 | ○ | ○ | ○ | ○ | ○ |
| 0.100 | 0.010 | 10.0 | ○ | ○ | ○ | ○ | ○ |
| 0.150 | 0.010 | 15.0 | ○ | ○ | ○ | ○ | ○ |
| 0.200 | 0.010 | 20.0 | ○ | ○ | ○ | ○ | ○ |
| 0.225 | 0.010 | 22.5 | Δ | x | x | x | x |
| 0.250 | 0.010 | 25.0 | x | x | x | x | x |

TABLE 7

| Production of Stripes in Sample M | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.040 | 0.0 | x | x | Δ | Δ | Δ |
| 0.004 | 0.040 | 0.1 | Δ | Δ | Δ | Δ | Δ |
| 0.008 | 0.040 | 0.2 | ○ | ○ | ○ | ○ | ○ |
| 0.020 | 0.040 | 0.5 | ○ | ○ | ○ | ○ | ○ |
| 0.040 | 0.040 | 1.0 | ○ | ○ | ○ | ○ | ○ |
| 0.200 | 0.040 | 5.0 | ○ | ○ | ○ | ○ | ○ |
| 0.400 | 0.040 | 10.0 | ○ | ○ | ○ | ○ | ○ |
| 0.600 | 0.040 | 15.0 | ○ | ○ | ○ | ○ | ○ |
| 0.800 | 0.040 | 20.0 | ○ | ○ | ○ | ○ | ○ |
| 0.900 | 0.040 | 22.5 | Δ | Δ | Δ | Δ | Δ |
| 1.000 | 0.040 | 25.0 | Δ | x | x | x | x |

TABLE 8

| Production of Stripes in Sample N | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.020 | 0.0 | x | x | x | x | x |
| 0.002 | 0.020 | 0.1 | x | x | x | Δ | Δ |
| 0.004 | 0.020 | 0.2 | ○ | ○ | ○ | ○ | ○ |
| 0.010 | 0.020 | 0.5 | ○ | ○ | ○ | ○ | ○ |
| 0.020 | 0.020 | 1.0 | ○ | ○ | ○ | ○ | ○ |
| 0.100 | 0.020 | 5.0 | ○ | ○ | ○ | ○ | ○ |
| 0.200 | 0.020 | 10.0 | ○ | ○ | ○ | ○ | ○ |
| 0.300 | 0.020 | 15.0 | ○ | ○ | ○ | ○ | ○ |
| 0.400 | 0.020 | 20.0 | ○ | ○ | ○ | ○ | ○ |
| 0.450 | 0.020 | 22.5 | Δ | Δ | Δ | x | x |
| 0.500 | 0.020 | 25.0 | x | x | x | x | x |

TABLE 9

| Production of Stripes in Sample N | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.010 | 0.0 | x | x | x | x | x |
| 0.001 | 0.010 | 0.1 | x | x | x | x | x |
| 0.002 | 0.010 | 0.2 | ○ | ○ | ○ | ○ | ○ |
| 0.005 | 0.010 | 0.5 | ○ | ○ | ○ | ○ | ○ |

TABLE 9-continued

| Production of Stripes in Sample N | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.010 | 0.010 | 1.0 | ○ | ○ | ○ | ○ | ○ |
| 0.050 | 0.010 | 5.0 | ○ | ○ | ○ | ○ | ○ |
| 0.100 | 0.010 | 10.0 | ○ | ○ | ○ | ○ | ○ |
| 0.150 | 0.010 | 15.0 | ○ | ○ | ○ | ○ | ○ |
| 0.200 | 0.010 | 20.0 | ○ | ○ | ○ | ○ | ○ |
| 0.225 | 0.010 | 22.5 | Δ | x | x | x | x |
| 0.250 | 0.010 | 25.0 | x | x | x | x | x |

TABLE 10

| Production of Stripes in Sample N | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.040 | 0.0 | x | x | x | Δ | Δ |
| 0.004 | 0.040 | 0.1 | Δ | Δ | Δ | Δ | Δ |
| 0.008 | 0.040 | 0.2 | ○ | ○ | ○ | ○ | ○ |
| 0.020 | 0.040 | 0.5 | ○ | ○ | ○ | ○ | ○ |
| 0.040 | 0.040 | 1.0 | ○ | ○ | ○ | ○ | ○ |
| 0.200 | 0.040 | 5.0 | ○ | ○ | ○ | ○ | ○ |
| 0.400 | 0.040 | 10.0 | ○ | ○ | ○ | ○ | ○ |
| 0.600 | 0.040 | 15.0 | ○ | ○ | ○ | ○ | ○ |
| 0.800 | 0.040 | 20.0 | ○ | ○ | ○ | ○ | ○ |
| 0.900 | 0.040 | 22.5 | Δ | Δ | Δ | Δ | Δ |
| 1.000 | 0.040 | 25.0 | Δ | x | x | x | x |

Example 3

Figure 6:
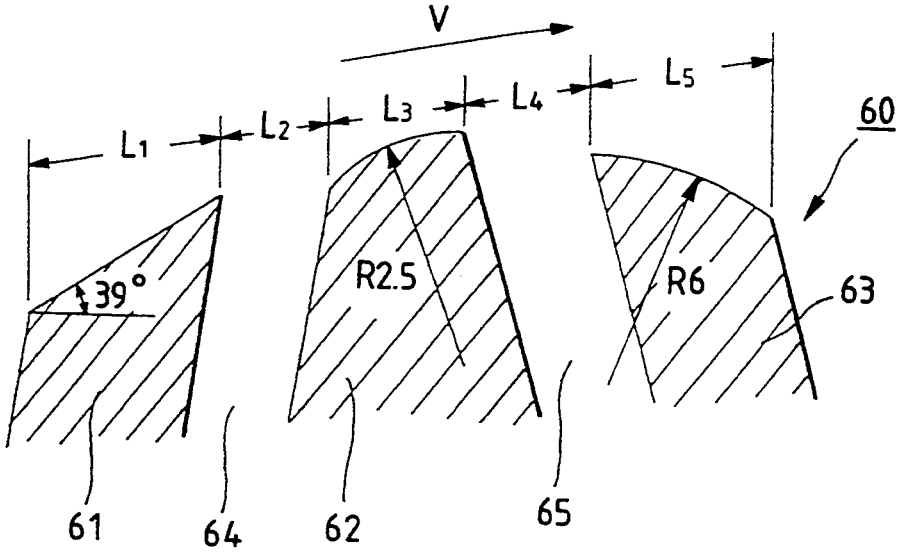
FIG. 6 PRIOR ART
FIG. 6 is a cross-sectional view of important parts of a coating head used in a comparative example.

For the coating head, two types of members each substantially having the structure shown in FIG. 3 were used. As a comparative example, coating was performed using the coating head shown in FIG. 6 (a coating head having the structure disclosed in Japanese Patent Unexamined Publication No. Sho-63-88080).

In sample X, the coating compositions A and B shown in Tables 1 and 2 were multilayer-applied by the coating head 20 shown in FIG. 3. In this case, the width $W_1$ of the front edge 2, the width $W_2$ of the back edge 3, the widths $L_1$ and $L_2$ of the slit portions *4a* and *4b*, the angle $\theta$ of the back edge top portion and the angle $\theta_1$ of the intermediate block top portion were set to be 1.0 mm, 1.0 mm, 0.3 mm, 0.3 mm, 55° and 20° respectively. Results are shown in Tables 11, 12 and 13.

On the other hand, as sample Y, the coating compositions A and B shown in Tables 1 and 2 were multilayer-applied by the coating head 20 shown in FIG. 3. In this case, the width $W_1$ of the front edge 2, the width $W_2$ of the back edge 3, the widths $L_1$ and $L_2$ of the slit portions *4a* and *4b*, the angle $\theta$ of the back edge top portion and the angle $\theta_1$ of the intermediate block top portion were set to be 1.5 mm, 1.0 mm, 0.3 mm, 0.4 mm, 55° and 20° respectively. The results were as shown in Tables 14, 15 and 16. The same conditions as in Example 1 were used for the support and the tension thereof.

The situation of production of stripes on the coating surface was measured by eyes while changing coating speed, perpendicular length $t_1$ and coating thickness $t_0$. While the length $t_1$ of a perpendicular to the intermediate block was set to be 50 μm, the perpendicular length $t_1$ was adjusted by moving the difference in level between the downstream end portion of the front edge and the top portion of the back edge and moving up and down the position of the conveyance roll 30. At that time, the coating composition pressure $P_c$ was not larger than 0.20 kgw/cm$^2$. In the evaluations shown in the respective Tables, represents superior surface characteristics of the coating film, Δ represents slightly inferior surface characteristics of the coating film, and X indicates the existence of problems in the form of stripes and unevenness of thickness which occur frequently.

TABLE 11

| Production of Stripes in Sample X | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.020 | 0.0 | x | x | x | x | x |
| 0.002 | 0.020 | 0.1 | x | x | x | Δ | Δ |
| 0.004 | 0.020 | 0.2 | o | o | o | o | o |
| 0.010 | 0.020 | 0.5 | o | o | o | o | o |
| 0.020 | 0.020 | 1.0 | o | o | o | o | o |
| 0.100 | 0.020 | 5.0 | o | o | o | o | o |
| 0.200 | 0.020 | 10.0 | o | o | o | o | o |
| 0.300 | 0.020 | 15.0 | o | o | o | o | o |
| 0.400 | 0.020 | 20.0 | o | o | o | o | o |
| 0.450 | 0.020 | 22.5 | Δ | Δ | x | x | x |
| 0.500 | 0.020 | 25.0 | x | x | x | x | x |

TABLE 12

| Production of Stripes in Sample X | | | | | | | |
|---|---|---|---|---|---|---|---|
| | | | Coating Speed (m/min) | | | | |
| $t_1$ (mm) | $t_2$ (mm) | $t_1/t_2$ | 100 | 200 | 300 | 400 | 500 |
| 0.000 | 0.010 | 0.0 | x | x | x | x | x |
| 0.001 | 0.010 | 0.1 | x | x | x | x | Δ |
| 0.002 | 0.010 | 0.2 | o | o | o | o | o |
| 0.005 | 0.010 | 0.5 | o | o | o | o | o |
| 0.010 | 0.010 | 1.0 | o | o | o | o | o |
| 0.050 | 0.010 | 5.0 | o | o | o | o | o |
| 0.100 | 0.010 | 10.0 | o | o | o | o | o |
| 0.150 | 0.010 | 15.0 | o | o | o | o | o |
| 0.200 | 0.010 | 20.0 | o | o | o | o | o |
| 0.225 | 0.010 | 22.5 | Δ | x | x | x | x |
| 0.250 | 0.010 | 25.0 | x | x | x | x | x |

TABLE 13

| Production of Stripes in Sample X | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.040 | 0.0 | x | x | Δ | Δ | Δ |
| 0.004 | 0.040 | 0.1 | Δ | Δ | Δ | Δ | Δ |
| 0.008 | 0.040 | 0.2 | o | o | o | o | o |
| 0.020 | 0.040 | 0.5 | o | o | o | o | o |
| 0.040 | 0.040 | 1.0 | o | o | o | o | o |
| 0.200 | 0.040 | 5.0 | o | o | o | o | o |
| 0.400 | 0.040 | 10.0 | o | o | o | o | o |
| 0.600 | 0.040 | 15.0 | o | o | o | o | o |
| 0.800 | 0.040 | 20.0 | o | o | o | o | o |
| 0.900 | 0.040 | 22.5 | Δ | Δ | Δ | Δ | x |
| 1.000 | 0.040 | 25.0 | Δ | x | x | x | x |

TABLE 14

| Production of Stripes in Sample X | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.020 | 0.0 | x | x | x | x | x |
| 0.002 | 0.020 | 0.1 | x | x | x | x | Δ |
| 0.004 | 0.020 | 0.2 | o | o | o | o | o |
| 0.010 | 0.020 | 0.5 | o | o | o | o | o |
| 0.020 | 0.020 | 1.0 | o | o | o | o | o |
| 0.100 | 0.020 | 5.0 | o | o | o | o | o |
| 0.200 | 0.020 | 10.0 | o | o | o | o | o |
| 0.300 | 0.020 | 15.0 | o | o | o | o | o |
| 0.400 | 0.020 | 20.0 | o | o | o | o | o |
| 0.450 | 0.020 | 22.5 | Δ | Δ | Δ | x | x |
| 0.500 | 0.020 | 25.0 | x | x | x | x | x |

TABLE 15

| Production of Stripes in Sample Y | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0 | 0.010 | 0 | x | x | x | x | x |
| 0.001 | 0.010 | 0.1 | x | x | x | x | x |
| 0.002 | 0.010 | 0.2 | o | o | o | o | o |
| 0.005 | 0.010 | 0.5 | o | o | o | o | o |
| 0.010 | 0.010 | 1.0 | o | o | o | o | o |
| 0.050 | 0.010 | 5.0 | o | o | o | o | o |
| 0.100 | 0.010 | 10.0 | o | o | o | o | o |
| 0.150 | 0.010 | 15.0 | o | o | o | o | o |
| 0.200 | 0.010 | 20.0 | o | o | o | o | o |
| 0.225 | 0.010 | 22.5 | Δ | x | x | x | x |
| 0.250 | 0.010 | 25.0 | x | x | x | x | x |

TABLE 16

| Production of Stripes in Sample Y | | | | | | | |
|---|---|---|---|---|---|---|---|
| | | | Coating Speed (m/min) | | | | |
| $t_1$ (mm) | $t_0$ (mm) | $t_1/t_0$ | 100 | 200 | 300 | 400 | 500 |
| 0.000 | 0.040 | 0.0 | x | x | x | x | Δ |
| 0.004 | 0.040 | 0.1 | Δ | Δ | Δ | Δ | Δ |
| 0.008 | 0.040 | 0.2 | o | o | o | o | o |
| 0.020 | 0.040 | 0.5 | o | o | o | o | o |
| 0.040 | 0.040 | 1.0 | o | o | o | o | o |
| 0.200 | 0.040 | 5.0 | o | o | o | o | o |
| 0.400 | 0.040 | 10.0 | o | o | o | o | o |
| 0.600 | 0.040 | 15.0 | o | o | o | o | o |
| 0.800 | 0.040 | 20.0 | o | o | o | o | o |
| 0.900 | 0.040 | 22.5 | Δ | Δ | Δ | Δ | Δ |
| 1.000 | 0.040 | 25.0 | x | x | x | x | x |

In making a comparison between the examples according to the present invention and the comparative examples, the case ($t_1$=0.05 mm) of the coating head used in sample X was used for the examples according to the present invention. The coating head 60 shown in FIG. 6 and used for the comparative examples was a support-pressure type apparatus having two slits 64 and 65 formed by edges 61, 62 and 63. The dimensions thereof were as follows: $L_1$=5.0 mm, $L_2$=0.3 mm, $L_3$=1.0 mm, $L_4$=0.3 mm, and $L_5$=3.0 mm.

The quantity of the coating composition A (lower layer) to be applied was set to be 12 cc/m$^2$. The quantity of the coating composition B (upper layer) to be applied was set to be 4 cc/m. The amount of variation in the thickness of the coating film (sum of upper and lower layers) and the amount of production of stripes caused by foreign matter were measured. The results are shown in Tables 17 and 18.

The amount of variation of the thickness of the coating film was calculated as follows:

(maximum variation of thickness in the direction of the width of the support/average thickness)×100(%)

TABLE 17

| Amount of Variation of Coating Film Thickness for Both Upper and Lower Layers | | | | | |
|---|---|---|---|---|---|
| | 100 | 200 | 300 | 400 | 500 |
| Comparative Example | 24% | 16% | 9% | 7% | 7% |
| Example (Invention) | 2% | 2% | 1% | 1% | 1% |

TABLE 18

| Production of Stripes Caused by Foreign Matter | | | | | |
|---|---|---|---|---|---|
| | 100 | 200 | 300 | 400 | 500 |
| Comparative Example | x | x | x | Δ | o |

TABLE 18-continued

| | Production of Stripes Caused by Foreign Matter | | | | |
|---|---|---|---|---|---|
| | 100 | 200 | 300 | 400 | 500 |
| Example (Invention) | ∘ | ∘ | ∘ | ∘ | ∘ |

It was apparent from Tables 3 through 18 that very good coating could be performed by setting the value of the ratio $t_1/t_0$ of the length of a perpendicular line from the front edge to the rear conveyance roll to the coating thickness to satisfy $0.2 \leqq t_1/t_0 \leqq 20$ while maintaining the coating composition pressure $P_c$ in a range of $0 \leqq P_c \leqq 0.25$ kgw/cm$^2$.

Example 4

Next, in the basic structure of the coating head 10 shown in FIG. 1, the gap width accuracy and straightness of the slit portion were examined.

The coating composition used was coating composition A shown in Table 1. Polyethylene terephthalate film having a thickness of 15 μm and a width of 500 mm was used as the support. The tension of the support was 10 kg/whole width. The coating speed was 600 m/min.

The gap width $L_0$ of the coating head was 300 μm. Coating was performed on the following five samples, which differed in gap width accuracy and straightness. The same conditions as in Example 1 were used for the support and the tension thereof.

(1) gap width accuracy: ±1% (±3 μm), straightness: 25 μm
(2) gap width accuracy: ±4% (±12 μm), straightness: 25 μm
(3) gap width accuracy: ±6% (±18 μm), straightness: 25 μm
(4) gap width accuracy: ±4% (±12 μm), straightness: 7 μm
(5) gap width accuracy: ±4% (±12 μm), straightness: 35 μm The coating thickness of the coating composition was 15 μm prior to drying. Stripe formation and thickness irregularities produced on the coating surfaces of the respective samples by the coating were examined. The results were as shown in Table 19. The evaluation (, Δ, X) in the Table was in accordance with that in Example 1.

TABLE 19

| Extruder | Clearance Accuracy | Straightness | Coating Result | Remarks |
|---|---|---|---|---|
| (1) | ±1% | 25 μm | ∘ | |
| (2) | ±4% | 25 μm | ∘ | |
| (3) | ±6% | 25 μm | x | Poor coating film thickness distribution |
| (4) | ±4% | 7 μm | ∘ | |
| (5) | ±4% | 35 μm | x | Poor coating film thickness distribution |

It is apparent from Table 19 that particularly uneven coating thickness occurred in samples (3) and (5), and that good results could be obtained in the other samples.

What is claimed is:

1. In a coating method for coating at least one coating composition onto a moving support with an extrusion coating head which has a front edge and at least one back edge, said front edge being disposed on an upstream side in a direction of movement of the support, said back edge being disposed on a downstream side of said coating head in the direction of movement of said support, said back edge having a top end which recedes stepwise further than said front edge in a direction away from said support, the improvement wherein coating is performed under conditions such that a pressure $P_c$ of said coating composition at a point of application of said coating composition onto said support is in a range of $0 \leqq P_c \leqq 0.25$ kgw/cm$^2$, a liquid-sealed state is effected between said support and said front edge with a composition containing an organic solvent applied in advance, and a ratio of $t_1/t_0$ satisfies the relation $0.2 \leqq t_1/t_0 \leqq 20$, where $t_0$ is a thickness of said coating composition just after coating on said support and prior to drying, and $t_1$ represents a length of a perpendicular line from a top end of a most downstream side back edge of said coating head to a tangent drawn between said front edge and a conveyance roller on the downstream side of said coating head.

2. The coating method according to claim 1, wherein a plurality of coating compositions are applied by said coating head onto said support, said coating composition pressure $P_c$ being at a point of application of an uppermost one of said coating compositions.

3. The coating method according to claim 1, wherein said organic solvent is at least one solvent selected from the group consisting of toluene, methyl ethyl ketone, butyl acetate, and cyclohexanone.

4. The coating method of claim 1, wherein a viscosity of said advance applied composition is not larger than 20 cp.

5. The coating method of claim 1, wherein a viscosity of said advance applied composition is not larger than 5 cp.

* * * * *